US007525244B2

(12) United States Patent
Chung et al.

(10) Patent No.: US 7,525,244 B2
(45) Date of Patent: Apr. 28, 2009

(54) FIELD EMISSION TYPE BACKLIGHT DEVICE

(75) Inventors: Deuk-seok Chung, Seongnam-si (KR); Jun-hee Choi, Suwon-si (KR); Min-jong Bae, Anyang-si (KR); Ha-jong Kim, Yongin-si (KR)

(73) Assignee: Samsung SDI Co., Ltd., Suwon (KR)

( * ) Notice: Subject to any disclaimer, the term of this patent is extended or adjusted under 35 U.S.C. 154(b) by 521 days.

(21) Appl. No.: 11/037,230

(22) Filed: Jan. 19, 2005

(65) Prior Publication Data

US 2005/0156506 A1 Jul. 21, 2005

(30) Foreign Application Priority Data

Jan. 20, 2004 (KR) ..... 10-2004-0004441

(51) Int. Cl.
*H01J 1/62* (2006.01)

(52) U.S. Cl. ..... 313/491; 313/495; 313/423

(58) Field of Classification Search ..... 313/495–497, 313/306, 309–311, 346, 346 R, 326, 351, 313/355, 293–304; 349/46–47, 139–40, 349/143

See application file for complete search history.

(56) References Cited

U.S. PATENT DOCUMENTS

| | | | | |
|---|---|---|---|---|
| 4,827,177 | A * | 5/1989 | Lee et al. | 313/306 |
| 5,760,858 | A | 6/1998 | Hodson et al. | 349/61 |
| 6,541,906 | B2 * | 4/2003 | Lee et al. | 313/495 |
| 6,614,149 | B2 * | 9/2003 | Kastalsky et al. | 313/310 |
| 6,794,814 | B2 * | 9/2004 | Lee et al. | 313/496 |

* cited by examiner

*Primary Examiner*—Peter J Macchiarolo
*Assistant Examiner*—Donald L Raleigh
(74) *Attorney, Agent, or Firm*—H. C. Park & Associates, PLC

(57) ABSTRACT

A field emission type backlight device with high light efficiency may include a front substrate, a reflective substrate on the front substrate, a rear substrate separated from the front substrate by a predetermined gap, anode electrodes provided with a predetermined gap between them on the rear substrate, a light-emitting layer on the anode electrode, a cathode electrode and a gate electrode spaced apart on the rear substrate between the anode electrodes, and an electron emission source emitting electrons by electric field on the cathode electrode.

6 Claims, 2 Drawing Sheets

FIELD EMISSION TYPE BACKLIGHT DEVICE

BACKGROUND OF THE INVENTION

This application claims the priority of Korean Patent Application No. 10-2004-0004441, filed on Jan. 20, 2004, in the Korean Intellectual Property Office, the disclosure of which is incorporated herein in its entirety by reference.

1. Field of the Invention

The present invention relates to a field emission type backlight device, and more particularly to a field emission type backlight device for a liquid crystal display (LCD) apparatus.

2. Description of the Related Art

An LCD apparatus has a backlight device in a rear side which typically supplies a white light. A cold cathode tube has been commonly used as a backlight device. Flat panel backlight devices, however, are required for thinner LCD apparatuses.

FIG. 1 is a sectional view showing a configuration of a conventional backlight device for the LCD apparatus.

A spacer (not shown) is provided between a front substrate 1 and a rear substrate 4. The space between the front substrate 1 and the rear substrate 4 is sealed with a wall (not shown). A cathode electrode 5 is provided in plane or stripe on the rear substrate 4. A field emission source such as a carbon nanotube (CNT) 6 is provided on the cathode electrode 5. On the front substrate 1 is an anode electrode 2, which is generally a transparent electrode. A light-emitting material 3 (which may be a fluorescent material) is deposited on the anode electrode 2.

When a predetermined voltage is applied between the cathode electrode 5 and the anode electrode 2, electrons are emitted from the field emission source 6 to excite the light-emitting layer 3. Light from the light-emitting layer 3 is incident on the LCD apparatus through the light-emitting layer 3, the anode electrode 2, and the front substrate 1.

A conventional flat panel backlight device can have non-uniform luminance because of a concentration of electron emission in the edge of the cathode electrode 5. In addition, since light is to be supplied to the LCD apparatus through the light-emitting layer 3 and the front substrate 1, light transmittance can be reduced due to the light-emitting layer 3. The bigger the LCD apparatus grows large in size, the bigger the non-uniformity in luminance.

There is a field emission device with good energy efficiency. For instance, in U.S. Pat. No. 5,760,858, a triode-structure field emission device is combined with a liquid crystal panel, so that it is possible to obtain a low power consuming backlight. In addition, it is possible to obtain uniform high luminance because the field emission device is in a surface emission mode.

However, the backlight device described in U.S. Pat. No. 5,760,858 has almost the same structure as a Spindt-type field emission display (FED). The Spindt-type field emission structure is fabricated at the same time when a liquid crystal panel is fabricated, and thus its fabricating process is complex. Moreover, since the field emission structure is fabricated using semiconductor fabricating processes, its production cost is high and its production yield is low.

SUMMARY OF THE INVENTION

The present invention provides, for example, a field emission type backlight device with good light transmittance having a field emission unit and a light emission unit on a rear substrate and a transparent electrode on a front substrate.

The present invention may provide a field emission type backlight device including a front substrate, a reflective electrode on the front substrate, a rear substrate which is separated from the front substrate by a predetermined gap, anode electrodes which are provided spaced apart on the rear substrate, a light-emitting layer (which may be a fluorescent material) on the anode electrode, a cathode electrode and a gate electrode which are apart from each other on the rear substrate between the anode electrodes; and an electron emission source emitting electrons on the cathode electrode.

A negative voltage may be applied to the reflective electrode in order to reflect (or deflect) electrons from the electron emission source and guide the electrons toward the light-emitting layer. Thus the reflective electrode may be reflective with respect to electrons, although it may also be transparent with respect to light.

The anode electrode, the gate electrode, and the cathode electrode may be arranged in parallel stripes.

The electron emission source may be made of a carbon such as graphite, diamond like carbon (DLC) or carbon nanotube (CNT), metal such as Mo or W, semiconductor such as Si, or dielectric such as lead zirconium titanate (PZT).

The reflective electrode may be an indium-tin-oxide (ITO) or indium-zinc-oxide (IZO) electrode and a flat panel electrode.

DETAILED DESCRIPTION OF THE INVENTION

Figure 1:
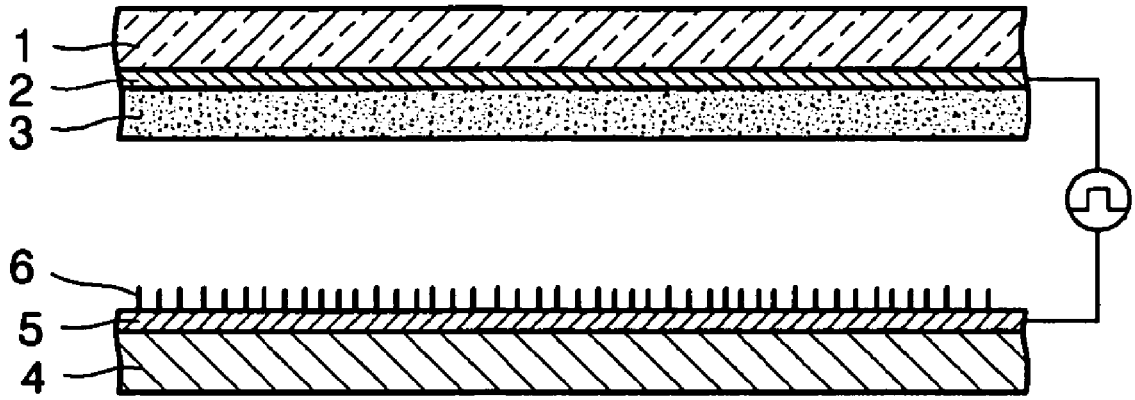
FIG. 1 (PRIOR ART)
FIG. 1 illustrates a schematic diagram of an LCD apparatus having a conventional field emission type backlight device.

Exemplary embodiments of a field emission type backlight device according to the present invention will be described in detail with reference to the accompanying drawings. The thicknesses of layers or regions shown in the drawings are exaggerated for clarity.

Figure 2:
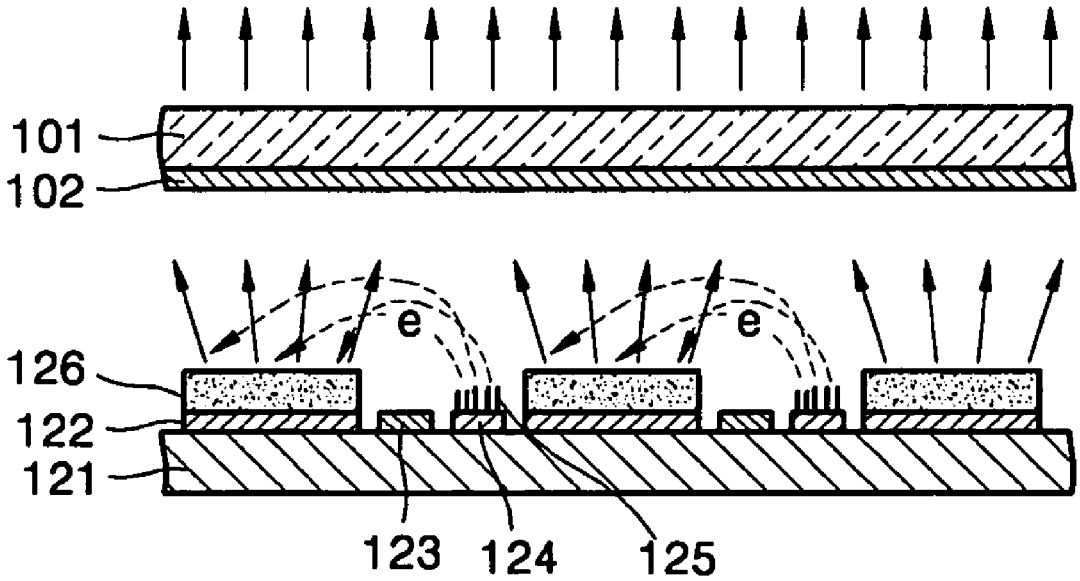
FIG. 2 illustrates a partially sectional view of a field emission type backlight device according to the present invention.

As shown in FIG. 2, a transparent front substrate 101 and a transparent or non-transparent rear substrate 121 may be separated from each other with a predetermined gap between them. The front substrate 101 disposed on a rear side of the LCD apparatus may transmit light from a light-emitting layer 126. The front and rear substrates 101 and 121 may be made of glass. The outer rims of the front and rear substrates 101 and 121 may be sealed with frit powder (not shown), so that vacuum may be maintained between these substrates. Also, a plurality of spacers (not shown) may be provided to ensure space between the front and rear substrates 101 and 121.

A reflective electrode 102 such as an ITO or IZO transparent electrode may be provided in the front substrate 101 in a shape of flat panel. A negative voltage may be applied to the reflective electrode 102.

Anode electrodes 122 may be provided on the rear substrate 121 with a predetermined gap between them. A cathode electrode 124 and a gate electrode 123 may be provided spaced out between anode electrodes 122. The anode electrode 122, the cathode electrode 124, and the gate electrode 123 may be spaced out. These electrodes may be made of approximately 0.25 μm thick Cr.

A light-emitting layer 126 of several tens of micrometers in thickness may be provided on the anode electrode 122. The light-emitting layer 126 may be provided on the rear substrate 121 and may function to emit light. The light-emitting layer 126 includes red (R), green (G), and blue (B) light-emitting layers to form a white light.

An electron emission source 125 on the cathode electrode 124 may emit electrons by means of an electric field generated by the gate electrode 123. The gate electrode 123 derives electrons from the electron emission source 125, and the derived electrons excite the light-emitting layer 126 to produce visible light.

Any material capable of emitting electrons in the electric field of a predetermined potential can be used as the electron emission source 125. For instance, graphite, diamond like carbon (DLC), or carbon nanotube (CNT), metal such as Mo or W, semiconductor such as Si, and dielectric such as lead zirconium titanate (PZT) can be used as the electron emission source 125. The electron emission source 125 can be formed on the cathode electrode 124 by a so-called thick film process of printing using material in a paste state, by electrophoresis, or by photolithography using a photomask.

A negative voltage may be applied to the reflective electrode 102 in order to guide electrons emitted from the electron emission source 125 to the light-emitting layer 126. The gate electrode 123 decides the direction in which electrons emitted from the electron emission source 125 proceed to the adjacent light-emitting layer 126. In other words, electrons emitted from the electron emission source 125 get bent to the light-emitting layer 126 on the side of the gate electrode 123 as shown in FIG. 2.

The cathode electrode 124, the gate electrode 123, and the anode electrode 122 can be in parallel stripes.

Forms and arrangements of the cathode and gate electrodes 124 and 123 can be implemented with a variety of embodiments. The illustrative forms or arrangements shown should not limit the scope of the present invention.

OPERATION OF THE EXEMPLARY EMBODIMENT

If a DC voltage pulse of several tens of volts is applied to the gate electrode 123, electrons may emit from the cathode electrode 124. These electrons may be guided by the gate electrode 123 and proceed toward the anode electrode 122 at the side of the gate electrode 123. If a negative voltage of several tens of volts is applied to the reflective electrode 102, electrons may be reflected (or deflected) downward by the reflective electrode 102 to proceed toward the anode electrode 122. The light-emitting layer 126 may thus be excited. Consequently, visible light may emit from the light-emitting layer 126 and proceed outward through the front substrate 101.

Since the light-emitting layer 126 is not provided on the front substrate 101 light transmittance may increase by about 20 to about 30%.

Figure 3:
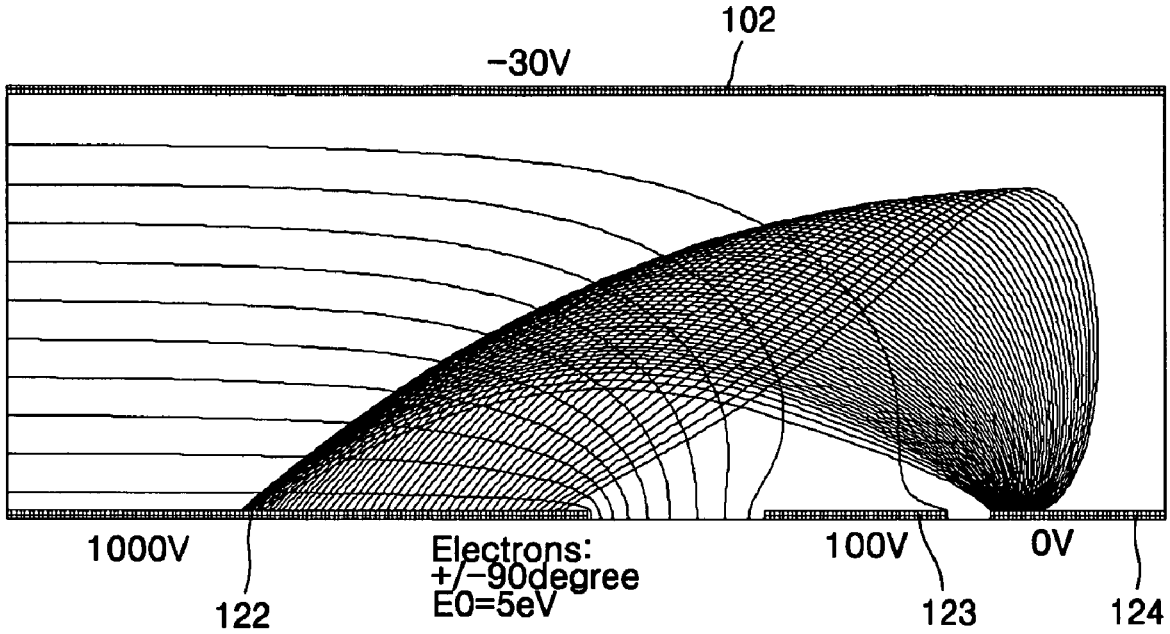
FIG. 3 illustrates a simulation of the electron flow in a field emission type backlight device according to the present invention.

Simulation of the Electron Flow in a Field Emission Type Backlight Device According to the Present Invention As shown in FIG. 3, for the simulation, the front substrate 101 and rear substrate 121 are separated from each other by preferably about 1.1 mm. The cathode electrode 124 is grounded. Voltage of 100 V is applied to the gate electrode 123. 1,000 V are applied to the anode electrode 122 and −30 V are applied to the reflective electrode 102, respectively. Electrons emitted from the cathode electrode 124 are reflected by the reflective electrode 102 and proceed toward the anode electrode 122 adjacent to the gate electrode 123.

Since the field emission type backlight device of the present invention has high light transmittance and uniform luminance, it can be used effectively as a backlight device for an LCD. While the present invention has been described with reference to exemplary embodiments thereof in conjunction with the drawings, various changes may be made without departing from the spirit and scope of the invention.

What is claimed is:

1. A field emission type light-emitting device, comprising:

a reflective electrode on a front substrate;

a rear substrate separated from the front substrate by a first gap;

an anode electrode on the rear substrate;

a light-emitting layer on the anode electrode;

a cathode electrode directly on the rear substrate;

a gate electrode on the rear substrate between the anode electrode and the cathode electrode; and an electron emission source on the cathode electrode, wherein a negative voltage source is coupled to the reflective electrode in sufficient amount to reflect electrons from the electron emission source and guide the electrons toward the light-emitting layer.

2. The device of claim 1, wherein the anode electrode, the gate electrode, and the cathode electrode are arranged in parallel stripes.

3. The device of claim 1, wherein the electron emission source comprises at least one of graphite, diamond like carbon, carbon nanotube, Mo, W, Si, and lead zirconium titanate.

4. The device of claim 1, wherein the reflective electrode comprises indium-tin-oxide or indium-zinc-oxide.

5. The device of claim 1, wherein the reflective electrode comprises a flat panel electrode.

6. The device of claim 1, wherein the light-emitting layer comprises a fluorescent layer.

* * * * *